US005845693A

United States Patent [19]

Cain

[11] Patent Number: 5,845,693

[45] Date of Patent: Dec. 8, 1998

[54] VERTICAL BLIND SYSTEM

[76] Inventor: Scott Cain, 300 Locksley Dr., Streamwood, Ill. 60107

[21] Appl. No.: 778,700

[22] Filed: Jan. 3, 1997

[51] Int. Cl.[6] ..... E06B 9/30

[52] U.S. Cl. ..... 160/168.1 V; 160/236

[58] Field of Search ..... 160/168.1 V, 173 V, 160/236, 178.1 V, 900, 172 V, 176.1 V

[56] References Cited

U.S. PATENT DOCUMENTS

| | | | |
|---|---|---|---|
| 2,188,575 | 1/1940 | McLennan | 160/172 V X |
| 4,115,898 | 9/1978 | Frentzel | 160/900 X |
| 4,262,728 | 4/1981 | Debs | 160/900 X |
| 4,407,350 | 10/1983 | Nakamura | 160/900 X |
| 5,012,552 | 5/1991 | Wulf | 160/168.1 V X |
| 5,143,136 | 9/1992 | John | 160/173 V |
| 5,458,939 | 10/1995 | Kitchen | 160/178.1 V X |

*Primary Examiner*—David M. Purol
*Attorney, Agent, or Firm*—Wood, Phillips, VanSanten, Clark & Mortimer

[57] ABSTRACT

A vertical blind system to selectively block and expose an area from a front vantage point. The vertical blind system includes first and second slats, each having a body with a top and bottom and a width between spaced substantially straight edges which extend between the top and bottom of each slat. A support/guide system maintains the first and second slats in an operative state and allows the first and second slats to be selectively repositioned between a) a first/open position wherein a space is defined between the first and second slats as viewed from the front vantage point and b) a second/closed position wherein the straight edge on the first slat horizontally overlaps the second slat a first predetermined amount as viewed from the front vantage point. There is a horizontal projection from one of the edges of one of the first and second slats so that the one of the edges and the projection cooperatively overlap the other of the first and second slats an amount greater than the first predetermined amount as viewed from the front vantage point with the first and second slats in the second/closed position.

25 Claims, 3 Drawing Sheets

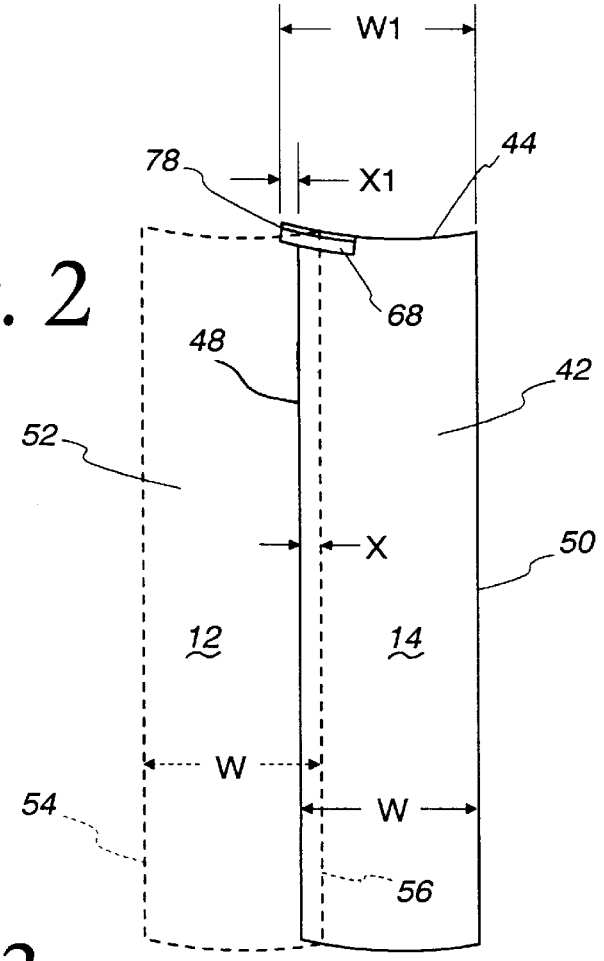
Fig. 2
Fig. 3
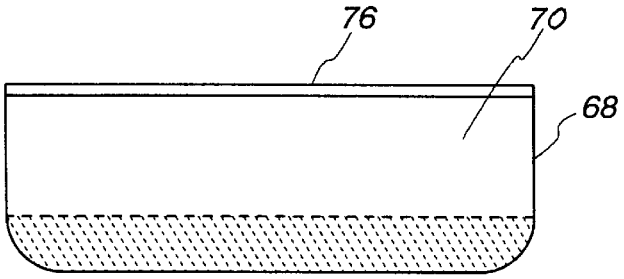
Fig. 4
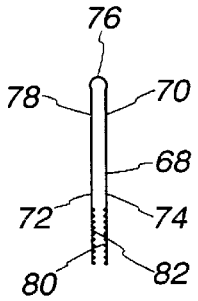
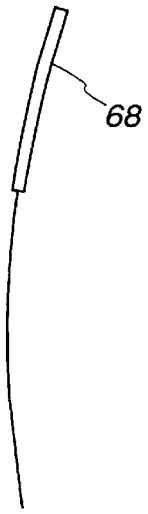
Fig. 5

Fig. 6
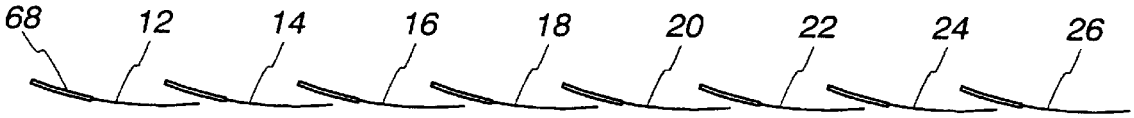
Fig. 7
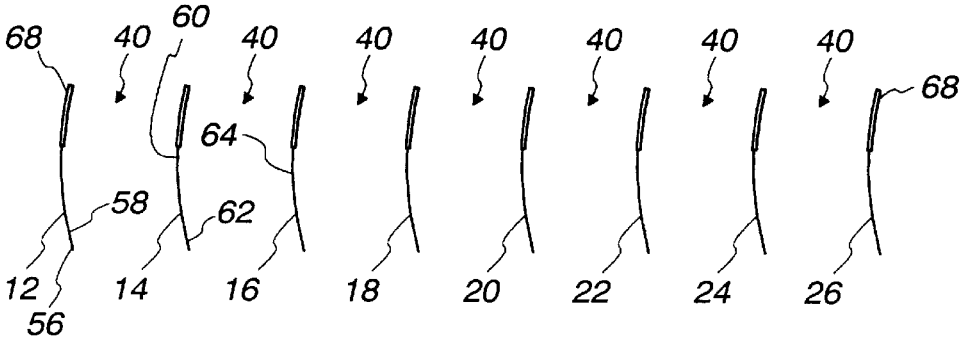
Fig. 8
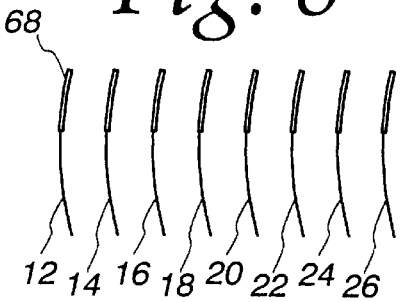
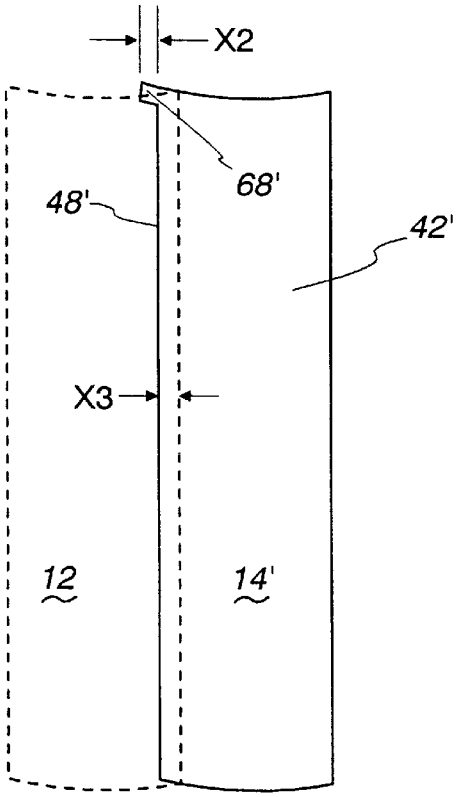
Fig. 9

VERTICAL BLIND SYSTEM

BACKGROUND OF THE INVENTION

1. Field of the Invention

This invention relates to vertical blind systems of the type having a plurality of vertically extending, repositionable slats.

2. Background Art

It is well known to construct vertical blind systems with a plurality of vertically extending slats. The slats are commonly made from metal, plastic or fabric with each slat having a body that is either flat or slightly bowed so as to be substantially flat. The slats are mounted in depending fashion from a support/guide system above an area which is selectively blocked and exposed from a front vantage point by repositioning the slats. Typically, an elongate guide track is mounted above the area to be covered cooperatively by the slats. Carriers on the track support the slats and are movable selectively along the length thereof. The slats can be moved through the carriers along the track between a first position, wherein the slats span the length of the track, and a second position, wherein the slats are accumulated at one end of the track. The actuator for effecting the position change for the slats may be a rod and/or flexible cord.

Through a gear operated actuator in this conventional system, the slats, in the first position therefor, are selectively movable between open and closed states. In the open state, the slats are oriented so that the planes defined by the bodies of the slats are fully spaced from and parallel to each other and generally parallel to the line of view from the front vantage point. In the closed state, the planes of the bodies of the slats are again generally parallel but substantially perpendicular to the line of view from the front vantage point. The slats thereby cooperatively define a blocking wall.

So that the slats cooperatively define a solid blocking surface, the slats are generally constructed to overlap each other in the closed state. The slats serially overlie each other in a predetermined pattern from one end of the track to the other to allow the slats to be changed between the open and closed states without binding. To minimize the overall weight of the vertical blind system, the slats ideally have a nominal overlap. By minimizing the overlap, the amount of projection of the track from the mounting surface therefor can likewise be minimized so that the overall system has a relatively unobtrusive configuration.

However, minimizing the overlap presents another problem. In a typical system, the slats are unsupported at their lower ends. As a result, the meshing pattern i.e. the serial overlapping of slats, is prone to being changed. Wind, contact by pets or children, or the like, may cause a slat that should be overlying the next adjacent slat to assume an underlying relationship. When it is desired to then change the slats from the closed state to the open state, this slat realignment may cause an interference between the slats that prohibits the slats from being placed in the open state. This may prompt the operator to exert an excessive force on the operator for the system as a result of which the mechanism and/or the slats may be bent or broken. This same misalignment problem may also interfere with the translational movement of the slats from the first position into the second position.

SUMMARY OF THE INVENTION

In one form, a vertical blind system is provided to selectively block and expose an area from a front vantage point. The vertical blind system includes first and second slats, each having a body with a top and bottom and a width between spaced substantially straight edges which extend between the top and bottom of each slat. A support/guide system maintains the first and second slats in an operative state and allows the first and second slats to be selectively repositioned between a) a first/open position wherein a space is defined between the first and second slats as viewed from the front vantage point and b) a second/closed position wherein the straight edge on the first slat horizontally overlaps the second slat a first predetermined amount as viewed from the front vantage point. There is a horizontal projection from one of the edges of one of the first and second slats so that the one of the edges and the projection cooperatively overlap the other of the first and second slats an amount greater than the first predetermined amount as viewed from the front vantage point with the first and second slats in the second/closed position.

The projection can be formed as one piece with the body of the one of the first and second slats or separately therefrom to be attached as by an adhesive or in any other suitable manner.

In one form, the projection piece is U-shaped with spaced legs that captively engaged the body of the one of the first and second slats.

The body of the one of the first and second slats has a top edge and a bottom edge. The projection piece can be attached at one of the top and bottom edges of the one of the first and second slats.

The projection piece can be made from plastic or other suitable material.

In one form, the one of the first and second slats has a width between the substantially straight edges thereon, with the edges being parallel to define a substantially uniform first width between the top and the bottom of the one of the first and second slats. The projection projects laterally beyond the one of the edges to produce a width that is greater than the first width between the other of the edges on the one of the first and second slats and the projection.

The projection can extend substantially less than the distance between the top and the bottom of the one of the first and second slats.

There may be a second projection from the one of the edges of the one of the first and second slats so that the one of the edges and the second projection cooperatively overlap the other of the first and second slats an amount greater than the first predetermined amount as viewed from the front vantage point with the first and second slats in the second/closed position.

The straight edges on the one of the first and second slats may extend substantially fully between the top and bottom of the body of the one of the first and second slats.

The invention also contemplates a slat for a vertical blind system, which slat has a body with a top and bottom and a width between first and second spaced substantially straight edges which extend between the top and bottom of the slat. There is a projection from one of the first and second edges which increases the width of the slat where the projection is located.

BRIEF DESCRIPTION OF THE DRAWINGS

FIG. 2 is an enlarged, fragmentary, front elevation view of two cooperating slats on the vertical blind system in FIG. 1 with a projection piece, according to the present invention, on one of the slats;

FIG. 3 is an enlarged, isolated, front elevation view of the projection piece, according to the present invention;

FIG. 4 is an enlarged, end elevation view of the inventive projection piece;

FIG. 5 is a fragmentary, side elevation view of one of the slats on the vertical blind system of FIG. 1 with the inventive projection piece thereon;

FIG. 6 is a plan view of the slats on the vertical blind system taken along line 6—6 of FIG. I with the slats in a closed position;

FIG. 7 is a view as in FIG. 6 with the slats in an open position;

FIG. 8 is a view as in FIGS. 6 and 7 with the slats in an open position and accumulated on one side of the vertical blind system; and FIG. 9 is a view as in FIG. 2 showing a modified form of projection, according to the present invention, formed as one piece with one of the slats.

DETAILED DESCRIPTION OF THE DRAWINGS

Figure 1:
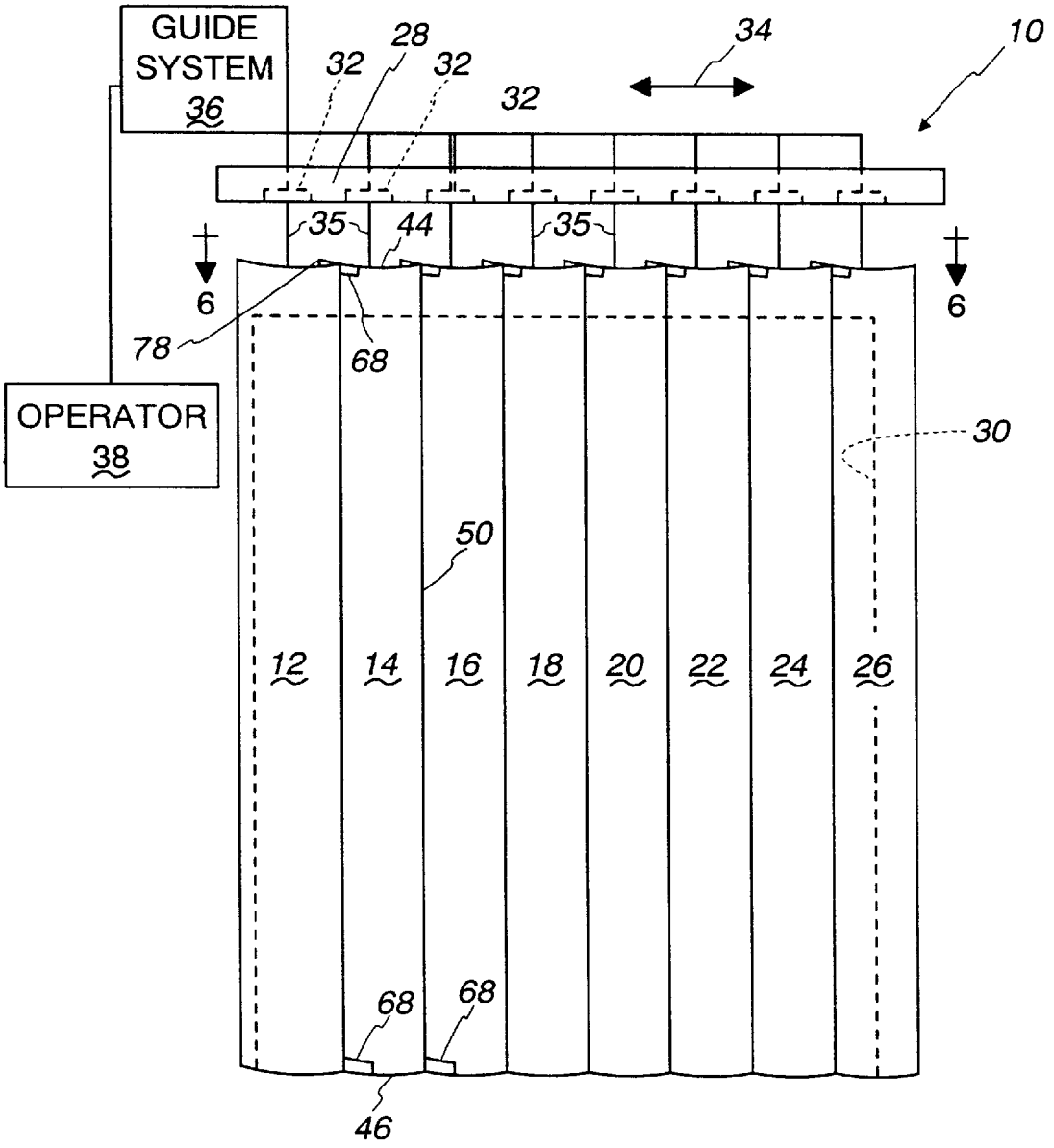
FIG. 1 is a front elevation view of a vertical blind system, according to the present invention, with a support/guide system for repositionable slats thereon shown partially in schematic form.

In FIG. 1, a vertical blind system, according to the present invention, is shown at 10. The vertical blind system 10 is made up of a plurality of elongate slats 12, 14, 16, 18, 20, 22, 24, 26 which are supported in depending fashion, in an operative state, from an elongate track 28 mounted fixedly above, in this case, a window 30. The vertical blind system 10 includes carriers 32, associated one each with the slats 12–26, which carriers 32 are movable guidingly along the length of the track 28, i.e. in the direction of the double-headed arrow 34. Each carrier 32 is connected to a slat 12–26 through a conventional hanger 35.

The blind system 10 includes a conventional guide system 36, controlled by an operator 38, through which the carriers 32 can be selectively moved between a first position, shown in FIGS. 1, 6 and 7, wherein the carriers 32 are spaced uniformnly along the length of the track 28, and a second position, shown in FIG. 8, wherein the carriers 32 and slats 12–26 are accumulated at one end of the track 28 to thereby expose a substantial portion of the window 30 as viewed from a front vantage point.

Through the guide system 36, the slats 12–26 can be reoriented from a closed position, as shown in FIGS. 1, 2 and 6, and an open position, as shown in FIG. 7. In the closed position of FIGS. 1, 2 and 6, the slats 12–26 cooperatively block the window 30 as viewed from the front vantage point. In the open position of FIG. 7, a space 40 is defined between adjacent slats 12–26 as viewed from the front vantage point.

Exemplary slat 14, in FIGS. 1, 2 and 9, has a body 42 with a top edge 44, a bottom edge 46 and horizontally spaced side edges 48, 50 which extend in substantially parallel relationship over the entire vertical extent of the slat 14. Between the edges 48, 50, the slat 14 has a width W, that is substantially uniform between the top edge 44 and bottom edge 46 thereof. The slat 12 has a body 52 with a similar configuration i.e. with laterally spaced edges 54, 56 defining a like width W.

As the slats 12–26 move from the open position of FIG. 7 to the closed position of FIGS. 1, 2 and 6, the slats 12–26 serially overlie each other. That is, the back surface 58 of the slat 12 overlies the front surface 60 of the slat 14. The back surface 62 of the slat 14 overlies the front surface 64 of the slat 16, and so on. The conventional overlap between adjacent slats 12–26 is identified by the dimension X in FIG. 2. Typically the dimension X is a nominal amount such as on the order of ¼ inch. With this overlap, the slats 12–26 cooperatively produce a solid blocking surface as viewed from the front vantage point with the slats 12–26 in the closed position in FIGS. 1, 2 and 6.

The slats 12–26 are generally made from fabric, thin metal, or plastic and are relatively light in weight. The amount of overlap X is chosen to minimize the required size of the slats 12–26 so that the overall weight of the system 10 is minimized. However, because the slats 12–26 are so light, they are prone to being realigned from the orientation shown in FIGS. 1–6, as when wind blows through the window 30 or when the slats 12–26 are manually inadvertently repositioned, as by children or pets. This repositioning may cause the overlap/underlap order to be varied. That is, for example, the edge 56 of the slat 12 may be inadvertently shifted from an overlying relationship with the slat 14 to an underlying relationship. As the guide system 36 is operated to change the slats 12–26 from the closed position to the open position, the slat 12 in this configuration will bind with the slat 14, rather than move unobstructedly from the closed position to the open position, as would otherwise occur.

To avoid this problem, the invention contemplates using a projection piece 68, as shown in each of FIGS. 1–8. The projection piece 68 has a body 70 that is U-shaped in cross section with legs 72, 74 joined by a bight portion 76. In one form, the projection piece 68 is a single piece formed of Mylar™ plastic with the legs 72, 74 being normally biased towards each other.

In FIG. 1, one projection piece 68 is shown attached to the top and bottom of the each of the slats 14–26. In exemplary slat 14, the top edge 44 thereof is pressed between the legs 72, 74 to be captively held thereby in an assembled position wherein the projection piece 68 extends in cantilever fashion beyond the edge 48 by an amount X1. As a result, the effective width between the free, projecting end 78 of the projection piece 68 and the edge 50, identified as W1, is greater than the width W between the edges 48, 50 of the slat 14. The projection piece 68 is attached in like fashion to the bottom edge 46 on the slat 14.

To enhance the connection between the projection pieces 68 and the slat 14, an adhesive layer 80 is provided on the inside of the leg 70, with a like adhesive layer 82 being provided on the inside of the leg 72. By spreading the legs 70, 72, the slat edge 44 can be projected fully therebetween to the bight portion 76, whereupon the legs 70, 72 can be released to engage the slat 14. The adhesive layers 80, 82 bond the projection piece 68 to the slat 14.

With this arrangement, the benefits of having a greater overlap region between the slats 12, 26 is realized, without having to make the slats 12–26 themselves wider along the entire vertical extent thereof. In this case, the effective overlap region is X plus X1, i.e. it is increased by the amount of extension X1 of the projection piece 68 beyond the edge 48 of the slat 14.

The projection pieces 68 can be relatively cheaply made and easily assembled. It is contemplated that the projection pieces 68 could be made from metal, or other suitable material. It is also within the scope of the invention to attach the projection pieces 68 to the slats 12–26 by other means, such as by rivets, screws, etc.

In FIG. 9, a modified form of slat 14' is shown. Rather than using a separate projection piece 68, a projection piece 68' is formed as one piece with the body 42' of the slat 14'.

In this case, the projection 68' extends horizontally outside of the line of the edge 48' a distance X2increasing the extent of overlap by that amount over the overlap distance X3 in the absence of the projection 68'. A like projection 68' can be formed on the bottom of the slat 14'.

The foregoing disclosure of specific embodiments is intended to be illustrative of the broad concepts comprehended by the invention.

What is claimed is:

1. A vertical blind system to selectively block and expose an area from a front vantage point, said vertical blind system comprising:

first and second slats each having a body with a top and bottom and a width between spaced substantially straight edges which extend between the top and bottom of each slat; and a support/guide system for maintaining the first and second slats in an operative state and for allowing the first and second slats to be selectively repositioned between a) a first/open position wherein a space is defined between the first and second slats as viewed from the front vantage point and b) a second/closed position wherein the straight edge on the first slat horizontally overlaps the second slat a first predetermined amount as viewed from the front vantage point, there being a horizontal projection from one of the edges of one of the first and second slats so that the one of the edges and the projection cooperatively overlap the other of the first and second slats an amount greater than the first predetermined amount as viewed from the front vantage point with the first and second slats in the second/closed position, there being no structure directly interconnecting the horizontal projection on the one of the first and second slats to the other of the first and second slats so that as the one of the first and second slats is changed from one of the first/open position and second/closed position into the other of the first/open position and second/closed position there is no force exerted through the horizontal projection on the one of the first and second slats causing the other of the first and second slats to follow movement of the one of the first and second slats.

2. The vertical blind system according to claim 1 wherein the projection is formed as one piece with the body of the one of the first and second slats.

3. The vertical blind system according to claim 1 wherein the projection comprises a piece that is formed separately from and attached to the body of the one of the first and second slats.

4. The vertical blind system according to claim 3 wherein an adhesive attaches the projection piece to the body of the one of the first and second slats.

5. The vertical blind system according to claim 3 wherein the projection piece comprises a U-shaped element with spaced legs that captively engage the body of the one of the first and second slats.

6. The vertical blind system according to claim 5 wherein the projection piece comprises plastic.

7.The vertical blind system according to claim 5 wherein the one of the first and second slats has a top edge and the piece is connected at the top of the one of the first and second slats.

8. The vertical blind system according to claim 3 wherein the body of the one of the first and second slats has a top edge and a bottom edge and the projection piece is attached at one of the top and bottom edges of the one of the first and second slats.

9. The vertical blind system according to claim 3 wherein the projection overlies an area of the one of the first and second slats, the area of the one of the first and second slats has substantially a uniform thickness, and there are no openings in the area of the one of the first and second slats.

10. The vertical blind system according to claim 3 wherein the one of the first and second slats has a top edge and the piece is connected at the top of the one of the first and second slats.

11. The vertical blind system according to claim 1 wherein the one of the first and second slats has a width between the substantially straight edges thereon, the substantially straight edges on the one of the first and second slats are substantially parallel to define a substantially uniform first width between the top and the bottom of the one of the first and second slats and the projection projects laterally beyond the one of the edges to produce a width that is greater than the first width between the other of the edges on the one of the first and second states and the projection.

12. The vertical blind system according to claim 11 wherein the substantially straight edges on the one of the first and second slats extend substantially fully between the top and the bottom of the body of the one of the first and second slats.

13. The vertical blind system according to claim 1 wherein the projection extends substantially less than a distance between the top and bottom of the one of the first and second slats.

14. The vertical blind system according to claim 1 wherein there is a second projection from the one of the edges of the one of the first and second slats so that the one of the edges and the second projection cooperatively overlap the other of the first and second slats an amount greater than the first predetermined amount as viewed from the front vantage point with the first and second slats in a second/closed position.

15. The vertical blind system according to claim 1 wherein the edge of the one of the first and second slats has a thickness taken transversely to the width of the body of the one of the first and second slats, the projection has a thickness and the thickness of the projection is no more than on the order of two times the thickness of the edge of the one of the first and second slats.

16. A slat for a vertical blind system, said slat comprising:

a body having a top and bottom and a width between first and second spaced substantially straight edges which extend between the top and bottom of the slat, there being a projection from one of the first and second edges which increases the width of the slat where the projection is located, wherein the one of the first and second edges has a thickness taken transversely to the width of the body and the projection has a thickness no more than on the order of two times the thickness of the one of the first and second edges.

17. The slat for a vertical blind system according to claim 16 wherein the projection is formed as one piece with the body of the slat.

18. The slat for a vertical blind system according to claim 16 wherein the projection comprises a piece that is formed separately from and attached to the body of the slat.

19. The slat for a vertical blind system according to claim 18 wherein an adhesive attaches the projection piece to the body of the slat.

20. The slat for a vertical blind system according to claim 18 wherein the projection comprises a U-shaped element with spaced legs that captively engage the body of the slat.

21. The vertical blind system according to claim 20 wherein the projection overlies an area of the one of the first and second slats, the area of the one of the first and second slats has substantially a uniform thickness, and there are no openings in the area of the one of the first and second slats.

22. The slat for a vertical blind system according to claim 16 wherein the first and second edges are substantially parallel to each other so that the body has a substantially uniform first width and the slat has a second width that is greater than the first width where the projection is located.

23. The slat for a vertical blind system according to claim 16 wherein the projection extends substantially less than a distance between the top and bottom of the body.

24. The slat for vertical blind system according to claim 16 wherein there is a second projection from one of the first and second edges which increases the width of the slat where the second projection is located.

25. The slat for a vertical blind system according to claim 16 wherein the body has a top edge and a bottom edge and the projection is provided on one of the top and bottom edges of the body.

* * * * *